US010638797B2

(12) United States Patent
Ellingson

(10) Patent No.: US 10,638,797 B2
(45) Date of Patent: May 5, 2020

(54) MALE UNDERGARMENT ASSEMBLY

(71) Applicant: Ronald E. Ellingson, Rochester, MN (US)

(72) Inventor: Ronald E. Ellingson, Rochester, MN (US)

( * ) Notice: Subject to any disclaimer, the term of this patent is extended or adjusted under 35 U.S.C. 154(b) by 346 days.

(21) Appl. No.: 15/873,348

(22) Filed: Jan. 17, 2018

(65) Prior Publication Data

US 2019/0216139 A1 Jul. 18, 2019

(51) Int. Cl.
*A41B 9/02* (2006.01)

(52) U.S. Cl.
CPC ..... *A41B 9/023* (2013.01)

(58) Field of Classification Search
CPC ..... A41B 9/02; A41B 9/023; A41B 9/026; A41B 9/001; A41B 9/004; A41D 7/005
USPC ..... 2/401, 403, 404
See application file for complete search history.

(56) References Cited

U.S. PATENT DOCUMENTS

| | | | | |
|---|---|---|---|---|
| 1,052,765 | A * | 2/1913 | Strauss | A41B 9/02 602/67 |
| 4,471,772 | A * | 9/1984 | Miller, Jr. | A61F 5/41 2/403 |
| 5,070,869 | A | 12/1991 | Zhang | |
| 5,647,065 | A * | 7/1997 | Richerson | A41B 9/023 2/227 |
| 5,870,779 | A | 2/1999 | Heron | |
| 6,901,607 | B1 * | 6/2005 | Elwell | A41B 9/023 2/400 |
| 7,166,095 | B1 * | 1/2007 | Coates | A61F 13/495 604/385.14 |
| 8,230,526 | B2 * | 7/2012 | Holland | A41D 7/005 2/400 |
| 9,713,348 | B2 * | 7/2017 | Astin | A41B 9/026 |
| 2006/0000008 | A1 * | 1/2006 | Chong | A41B 9/023 2/403 |
| 2007/0277285 | A1 * | 12/2007 | Gravette | A41B 9/023 2/78.1 |
| 2011/0154560 | A1 * | 6/2011 | Hoffman | A41B 9/023 2/405 |
| 2012/0260404 | A1 * | 10/2012 | Steele | A41B 9/023 2/404 |
| 2013/0104293 | A1 * | 5/2013 | Gu | A41B 9/023 2/404 |
| 2018/0084837 | A1 * | 3/2018 | Ng | A41B 9/023 |
| 2019/0116889 | A1 * | 4/2019 | Kimel | A41B 9/023 |

FOREIGN PATENT DOCUMENTS

| | | | | |
|---|---|---|---|---|
| CA | 2747893 | A1 * | 1/2013 | A41B 9/023 |
| DE | 1610538 | A1 * | 7/1971 | A61F 5/40 |

* cited by examiner

*Primary Examiner* — Amy Vanatta

(57) ABSTRACT

A male undergarment assembly includes a pair of briefs including a front wall, a rear wall, a first side wall and a second side wall. The pair of briefs has an upper edge that is open and defines a waistband. The pair of briefs has a bottom wall has a pair of leg openings therein. A pouch is attached to an inner surface of the front wall. The pouch has an inner wall and an outer wall joined together along their respective bottom edges. The outer wall is positioned between the front wall and the inner wall. The inner wall has an aperture extending therethrough and for receiving a penis. A sling is attached to the inner wall and extends downwardly therefrom. The sling is attached to the briefs between the leg openings and is utilized to receive a person's testicles.

12 Claims, 6 Drawing Sheets

MALE UNDERGARMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to male briefs and more particularly pertains to a new male briefs for providing greater comfort and support for the wearer.

BRIEF SUMMARY OF THE INVENTION

An embodiment of the disclosure meets the needs presented above by generally comprising a pair of briefs including a front wall, a rear wall, a first side wall and a second side wall. The pair of briefs has an upper edge that is open and defines a waistband. The pair of briefs has a bottom wall has a pair of openings therein defining leg openings. A pouch is attached to an inner surface of the front wall. The pouch has an inner wall and an outer wall joined together along their respective bottom edges. The outer wall is positioned between the front wall and the inner wall. The inner wall has an aperture extending therethrough and for receiving a penis. A sling is attached to the inner wall and extends downwardly therefrom. The sling is attached to the briefs between the leg openings and is utilized to hold and support a person's testicles away from a person's skin.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
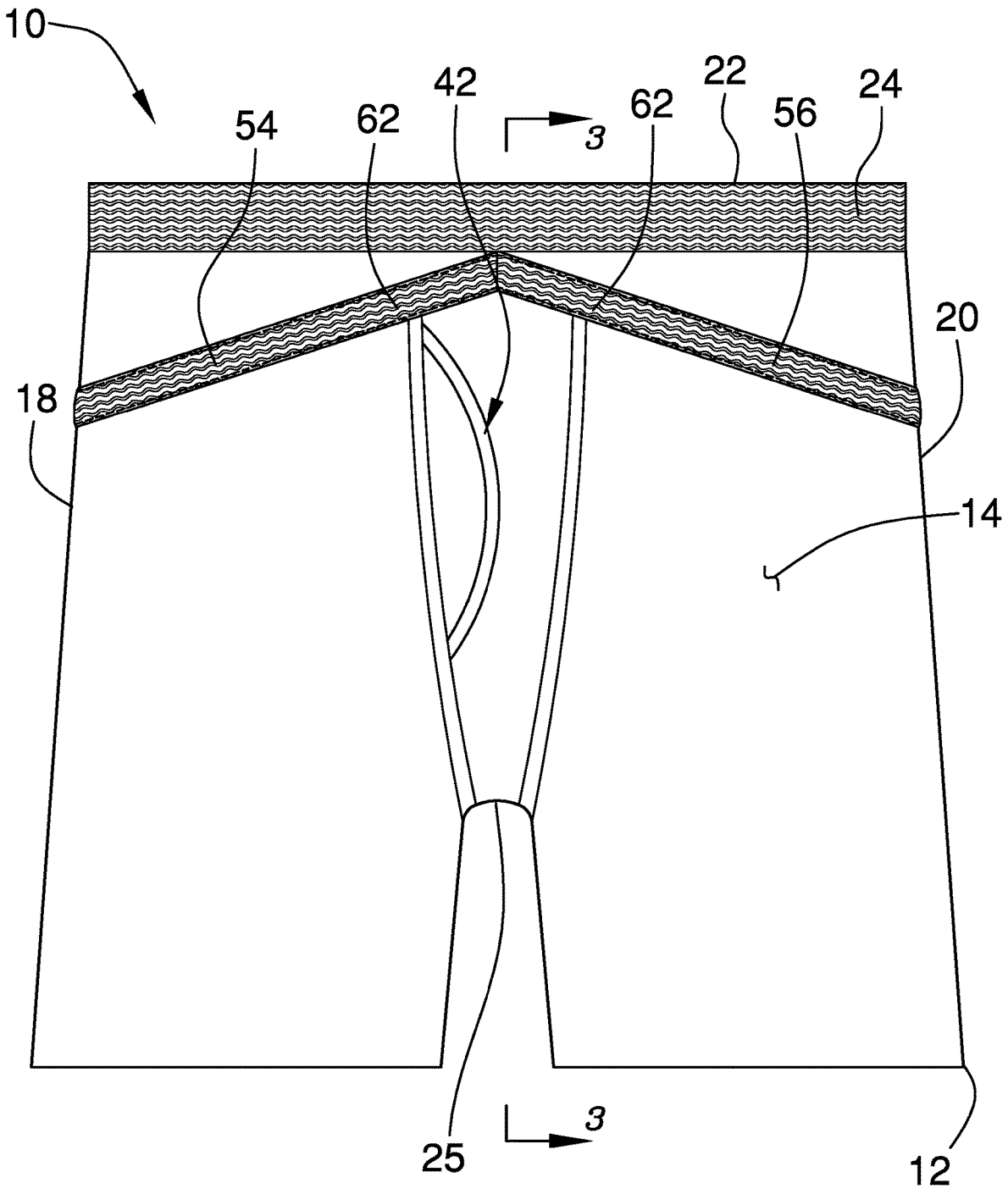
FIG. 1 is a front view of a male undergarment assembly according to an embodiment of the disclosure.
Figure 2:
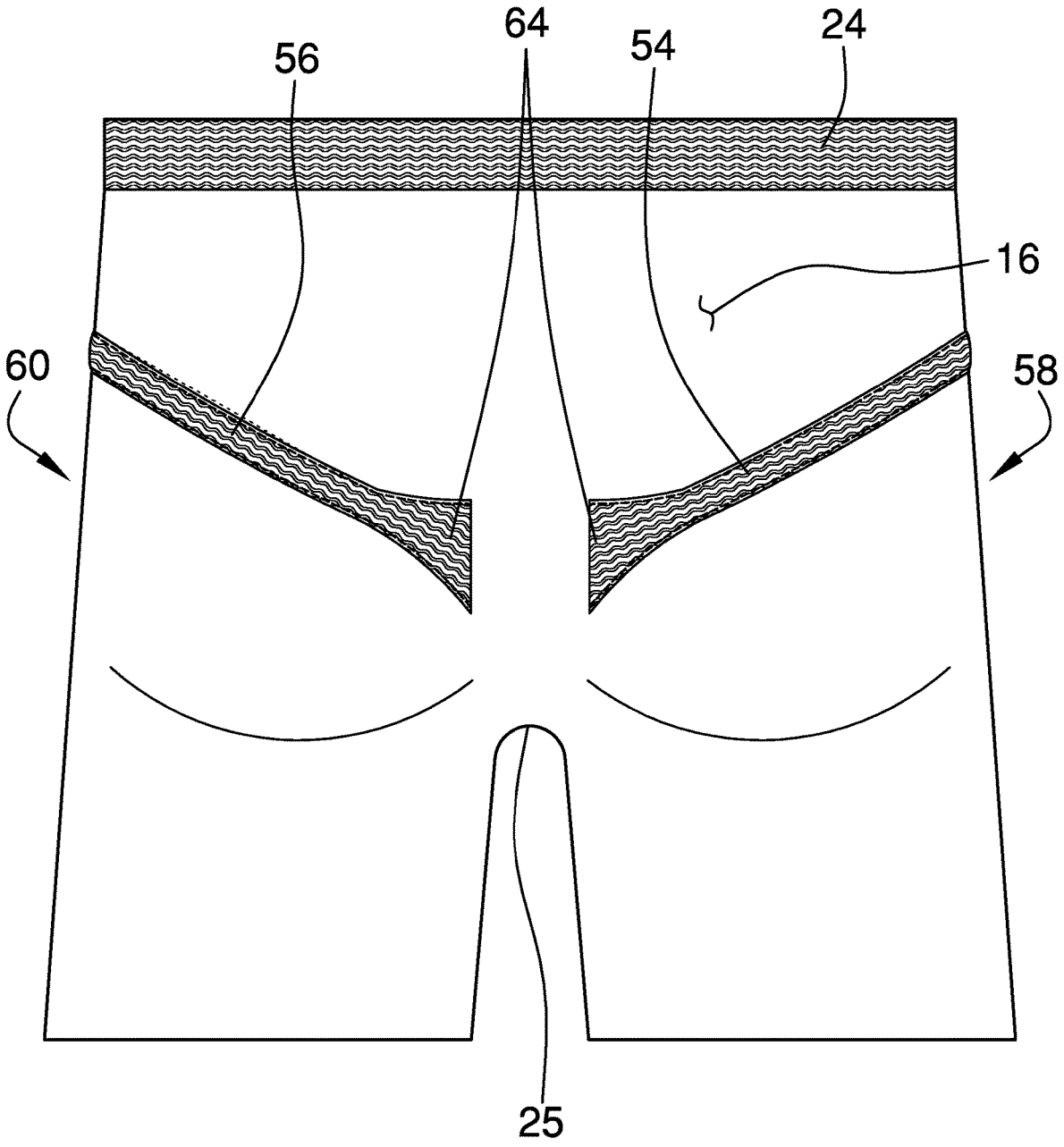
FIG. 2 is a rear view of an embodiment of the disclosure.
Figure 3:
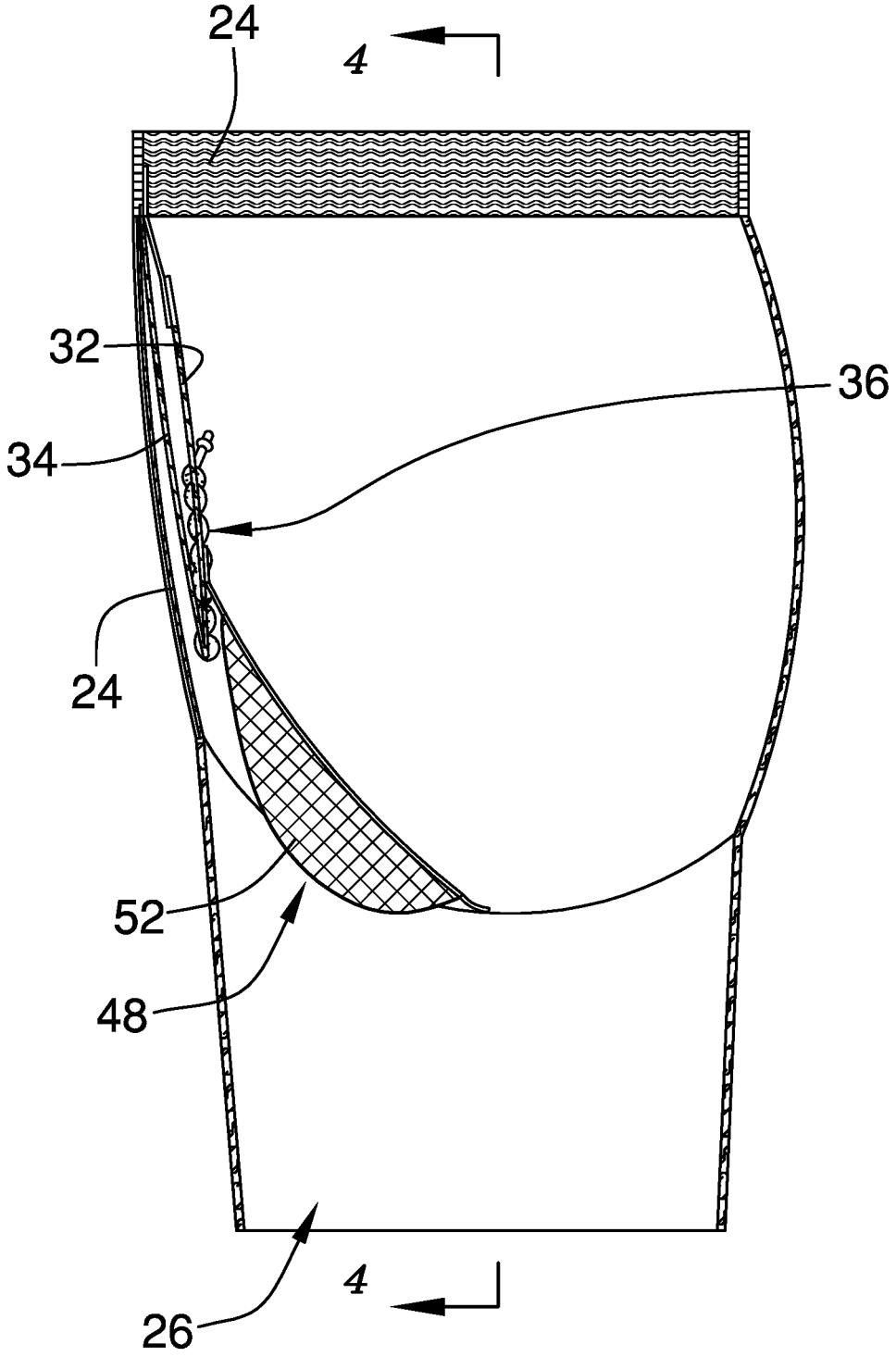
FIG. 3 is a cross-sectional view of an embodiment of the disclosure taken along line 3-3 of FIG. 1.
Figure 4:
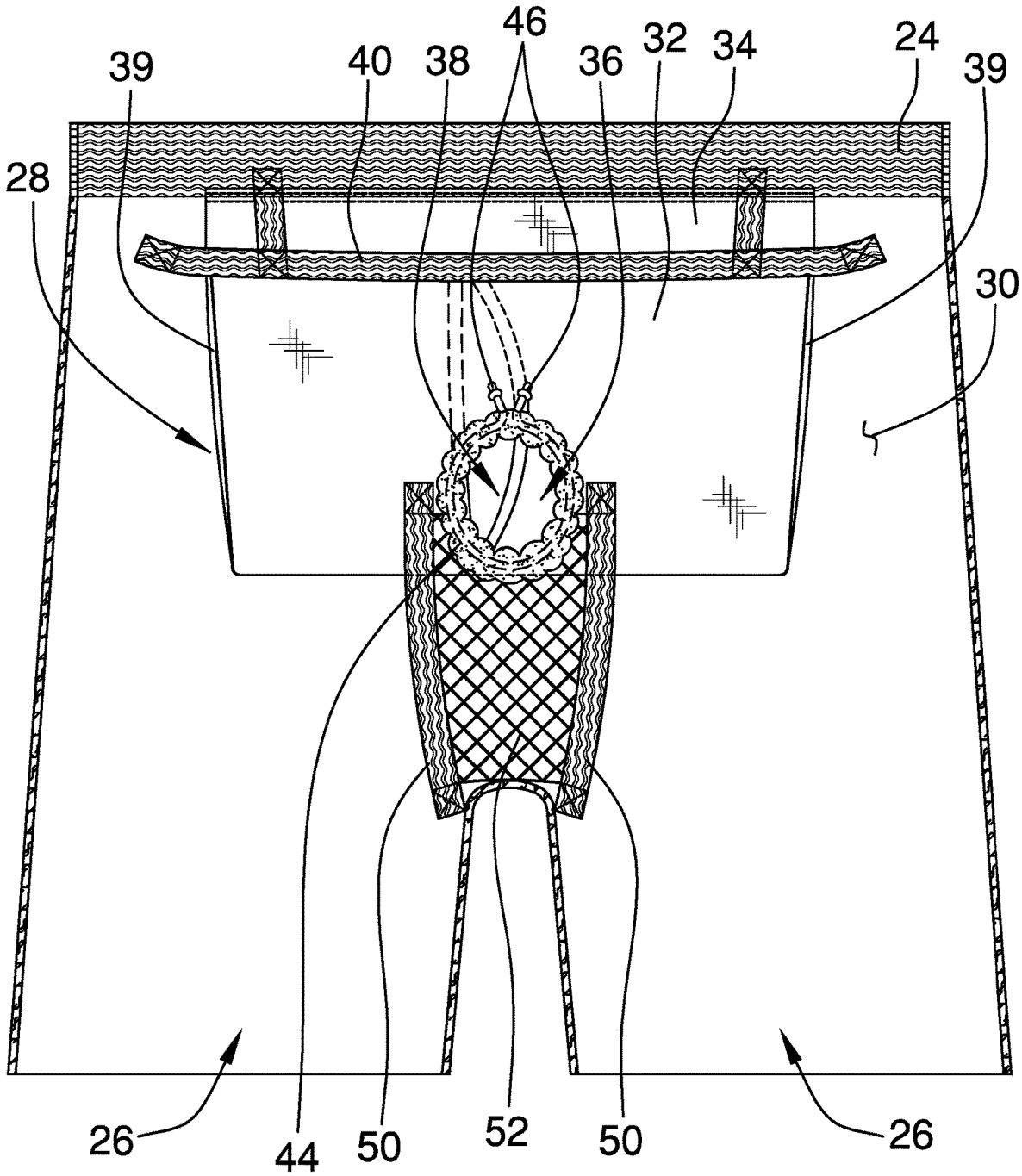
FIG. 4 is a cross-sectional view of an embodiment of the disclosure taken along line 4-4 of FIG. 3.
Figure 5:
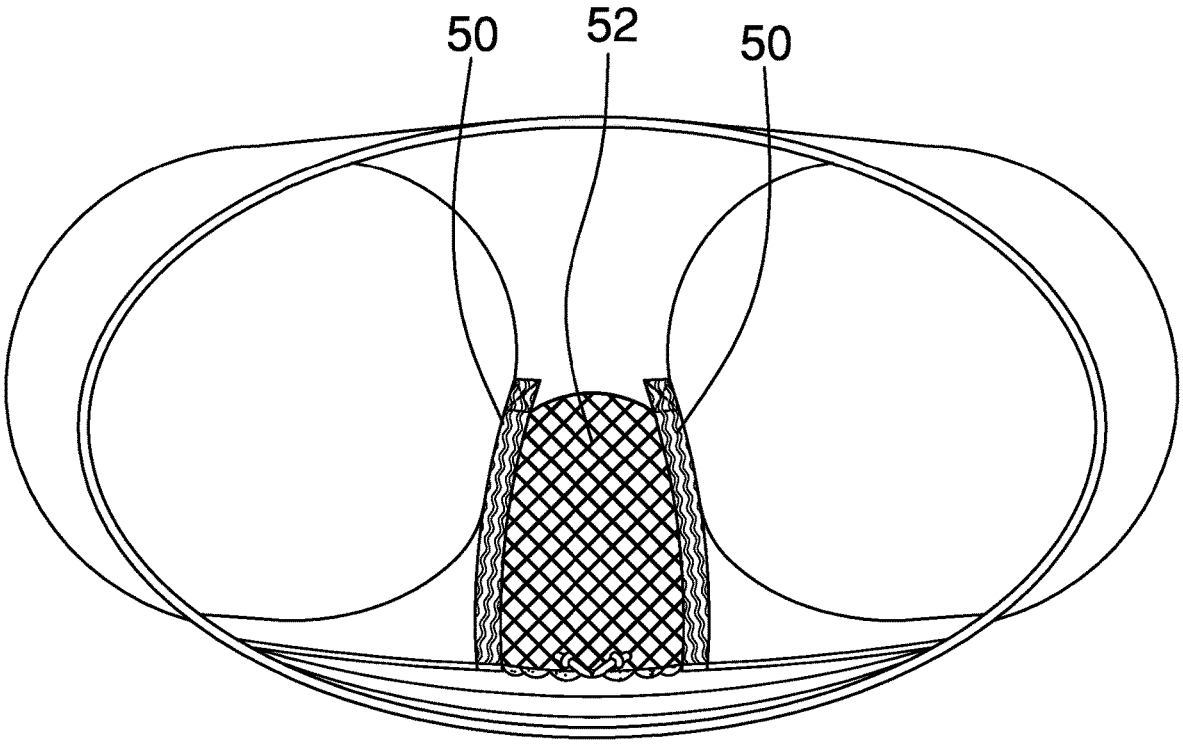
FIG. 5 is a top view of an embodiment of the disclosure.
Figure 6:
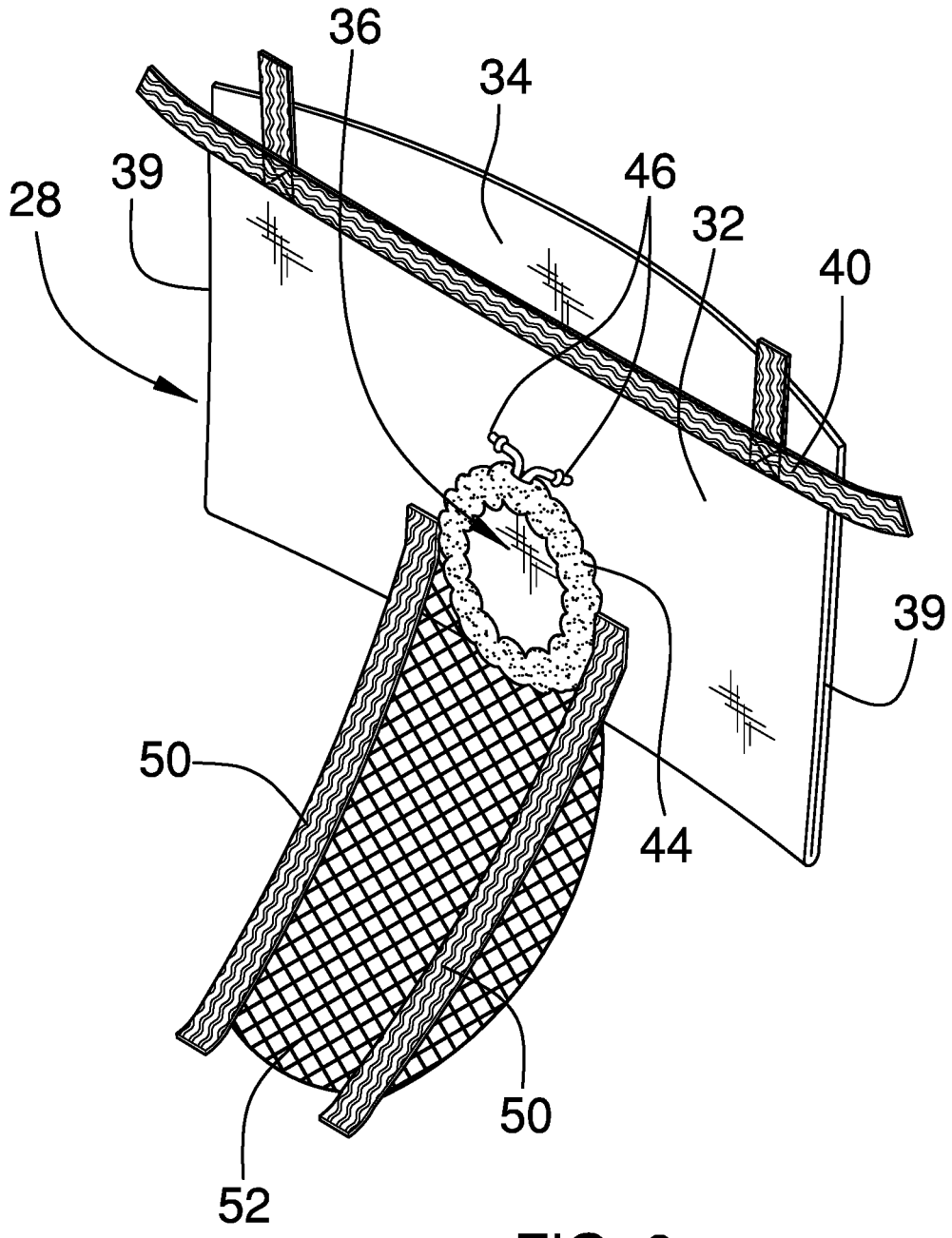
FIG. 6 is a rear perspective view of an embodiment of the disclosure of a pouch that will be positioned within a pair of briefs.

With reference now to the drawings, and in particular to FIGS. 1 through 5 thereof, a new male briefs embodying the principles and concepts of an embodiment of the disclosure and generally designated by the reference numeral 10 will be described.

As best illustrated in FIGS. 1 through 5, the male undergarment assembly 10 generally comprises a pair of briefs 12, which are generally conventional, and include a front wall 14, a rear wall 16, a first side wall 18 and a second side wall 20. The pair of briefs 12 has an upper edge 22 that is open and defines a waistband 24. The pair of briefs 12 has a bottom wall 25 having a pair of openings therein defining leg openings 26. It should be understood that term "wall" is being used for clarification and that the pair of briefs 12 might be, and likely will be, comprised of a single piece of cloth material. The leg openings 26 may be extended through leg sleeves if the pair of briefs are boxer briefs, for example. The pair of briefs 12 may be constructed of conventional materials used for male undergarments and therefore may include cloth materials made of natural and/or synthetic fibers. Further, the cloth materials 12 may include resiliently stretchable fibers/materials.

A pouch 28 is attached to an inner surface 30 of the front wall 14. The pouch 28 has an inner wall 32 and an outer wall 34 that are joined together along their respective bottom edges and which may be formed from a single, continuous portion of cloth. The outer wall 34 is positioned between the front wall 24 and the inner wall 32. The inner wall 32 has an aperture 36 extending therethrough that is configured to receive a penis. The pouch 28 extends downwardly from the waistband 24 and may have a pair of lateral edges 39 and an upper edge 40 that are each open to allow for easy access into the pouch 28. The outer wall 34 may further have an access opening 38 extending therethrough that is aligned with an outer opening 42 extending through the front wall 24. The outer opening 42 is conventional to male undergarments and may be utilized for easy access to the wearer's penis while urinating.

A loop 44 is attached to the pouch 28 and is coextensive with a perimeter edge of the aperture 36. The loop 44 is comprised of a resiliently stretchable material to cinch the perimeter edge of the aperture 36 around the penis. The loop 44 may include a ruffled fabric or may comprise a tether formed into a closed loop and sewn into the pouch 28 or a drawstring that has a pair of ends 46 extendable outwardly away from the aperture 36. The drawstring ends 46 may be pulled to make the aperture 36 smaller in a conventional manner and also allows the aperture 36 to be loosened and widened as needed.

A sling 48 is attached to the inner wall 32 and extends downwardly therefrom. The sling 48 is attached to the briefs 12 between the leg openings 26 and is configured to separate a person's testicles from the surrounding skin in the groin area and may also offer support for the testicles. The sling 48 includes a pair of lateral straps 50 each being attached to and extending between the pouch 28 and the pair of briefs 12. A flexible panel 52 is attached to and extends between the lateral straps 50. The lateral straps 50 each comprise a resiliently stretchable material and the panel 52 may comprise a mesh material.

A first lateral band 54 and a second lateral band 56 are provided. Each of the first 54 and second 56 lateral bands is attached to the pair of briefs 12. The first lateral band 54 is attached to a first lateral side 58 of the pair of briefs 12 and the second lateral band 56 is attached to the second lateral side 60 of the pair of briefs 12. More specifically, each band 54, 56 has a starting end 62 positioned on the front wall 14 adjacent to the waistband 24 and a terminal end 64 that is positioned on the back wall 16. The terminal ends 64 are spaced laterally from each other and each of the first 54 and second 56 lateral bands are angled downwardly as they travel from the front wall 14 to the rear wall 16. This places the terminal ends 64 over the buttocks when the assembly 10 is being worn. The first 54 and second 56 lateral bands are comprised of a resiliently stretchable material such that a central area of the rear wall 16 is biased toward the first 54 and second 56 lateral sides and in turn this causes the central area to remain taut such that it does not move into and bunch up in the wearer's intergluteal cleft.

In use, the assembly 10 is used as would be conventional briefs or boxers, but the user extends their penis through the aperture 36 so that the penis is held within the pouch and separated from the testicles. This provides greater comfort due to the lack of rubbing and sticking between the penis and the scrotum. Additionally, the scrotum and testicles are properly separated from surrounding skin while within the sling 48 while the mesh material facilitates cooling thereof.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An undergarment assembly configured to retain separation between a person's penis and testicles, said undergarment comprising:

a pair of briefs including a front wall, a rear wall, a first side wall and a second side wall, said pair of briefs having an upper edge being open and defining a waistband, said pair of briefs having a bottom wall having a pair of openings therein defining leg openings;

a pouch being attached to an inner surface of said front wall, said pouch having an inner wall and an outer wall being joined together along their respective bottom edges, said outer wall being positioned between said front wall and said inner wall, said inner wall having an aperture extending therethrough and being configured to receive a penis; and a sling being attached to said inner wall and extending downwardly therefrom, said sling being attached to said briefs between said leg openings, said sling being configured to receive a person's testicles.

2. The undergarment assembly according to claim 1, wherein said pouch extends downwardly from said waistband.

3. The undergarment assembly according to claim 1, wherein said pouch has a pair of lateral edges being open.

4. The undergarment assembly according to claim 1, wherein said outer wall has an access opening extending therethrough, said access opening being aligned with an outer opening extending through said front wall.

5. The undergarment assembly according to claim 2, wherein said pouch has a top edge being open.

6. The undergarment assembly according to claim 1, wherein said sling includes a pair of lateral straps each being attached to and extending between said pouch and said pair of briefs, a flexible panel being attached to and extending between said lateral straps.

7. The undergarment assembly according to claim 6, wherein said lateral straps each comprise a resiliently stretchable material.

8. The undergarment assembly according to claim 6, wherein said flexible panel comprises a mesh material.

9. The undergarment assembly according to claim 1, further including a loop being attached to said pouch and being coextensive with a perimeter edge of said aperture, said loop being comprising of a resiliently stretchable material to cinch said perimeter edge of said aperture to the penis.

10. The undergarment assembly according to claim 9, wherein said loop includes a drawstring having a pair of ends being extendable outwardly away from said aperture to make said aperture smaller.

11. The undergarment assembly according to claim 1, further including a first lateral band and a second lateral band, each of said first and second lateral bands being attached to said pair of briefs, said first lateral band being attached to a first lateral side of said pair of briefs and said second lateral band being attached to a second lateral side of said pair of briefs, said first and second lateral bands biasing a central area of said rear wall toward said first and second lateral sides such that said central area remains taut.

12. An undergarment assembly configured to retain separation between a person's penis and testicles, said undergarment comprising:

a pair of briefs including a front wall, a rear wall, a first side wall and a second side wall, said pair of briefs having an upper edge being open and defining a waistband, said pair of briefs having a bottom wall having a pair openings therein defining leg openings;

a pouch being attached to an inner surface of said front wall, said pouch having an inner wall and an outer wall being joined together along their respective bottom edges, said outer wall being positioned between said front wall and said inner wall, said inner wall having an aperture extending therethrough and being configured to receive a penis, said pouch extending downwardly from said waistband, said pouch having a pair of lateral edges being open, said outer wall having an access opening extending therethrough, said access opening being aligned with an outer opening extending through said front wall, said pouch having a top edge being open;

a sling being attached to said inner wall and extending downwardly therefrom, said sling being attached to said briefs between said leg openings, said sling being configured to receive a person's testicles, said sling including a pair of lateral straps each being attached to and extending between said pouch and said pair of briefs, a flexible panel being attached to and extending between said lateral straps, said lateral straps each comprising a resiliently stretchable material, said flexible panel comprising a mesh material;

a loop being attached to said pouch and being coextensive with a perimeter edge of said aperture, said loop being comprising of a resiliently stretchable material to cinch said perimeter edge of said aperture to the penis, said loop including a drawstring having a pair of ends being extendable outwardly away from said aperture to make said aperture smaller; and a first lateral band and a second lateral band, each of said first and second lateral bands being attached to said pair of briefs, said first lateral band being attached to a first lateral side of said pair of briefs and said second lateral band being attached to a second lateral side of said pair of briefs, said first and second lateral bands biasing a central area of said rear wall toward said first and second lateral sides such that said central area remains taut.

* * * * *